United States Patent [19]

Richter

[11] 4,159,137

[45] Jun. 26, 1979

[54] ADJUSTABLE MULTIPIVOT PANEL LATCH

[75] Inventor: Robert D. Richter, Harbor City, Calif.

[73] Assignee: Tridair Industries, Torrance, Calif.

[21] Appl. No.: 857,674

[22] Filed: Dec. 5, 1977

[51] Int. Cl.[2] ..... E05C 3/08; E05C 3/30

[52] U.S. Cl. ..... 292/123; 292/DIG. 49; 292/DIG. 60

[58] Field of Search ..... 292/123, 196, 97, 223, 292/DIG. 49, DIG. 60

[56] References Cited

U.S. PATENT DOCUMENTS

| | | | |
|---|---|---|---|
| 2,750,217 | 6/1956 | Landholt | 292/97 |
| 2,927,812 | 3/1960 | Smith et al. | 292/DIG. 31 |
| 4,053,177 | 10/1977 | Stammreich et al. | 292/DIG. 31 |

*Primary Examiner*—Richard E. Moore
*Attorney, Agent, or Firm*—Thomas A. Seeman

[57] ABSTRACT

An adjustable, multipivot aircraft panel latch featuring a means for adjusting the latch tension after the panel is installed without the necessity of opening the latch. This is accomplished by an adjustment screw mounted on a yoke member in operative engagement with the latch arm. By the particular arrangement of components, the latch arm may be adjusted relative to a keeper on the aircraft structure by rotating the screw with a conventional drive tool inserted through a small opening in the top of the latch housing.

2 Claims, 4 Drawing Figures

ADJUSTABLE MULTIPIVOT PANEL LATCH

BACKGROUND OF THE INVENTION

This invention relates to a panel latch and more particularly, to an adjustable, multipivot, flush-mounted panel latch of the type used to secure aircraft panels.

Latches are commonly used to secure aircraft panels to an aircraft structure, where, for example, it is desired to gain access to the interior of the aircraft for maintenance and the like. Typically, the latch housing is flush-mounted with the aircraft panel, and, when the latch is installed and closed, a latch arm of the latch engages a keeper on the aircraft structure, thereby securing the panel.

For adequate attachment of the panel to the aircraft structure, it is essential that the latch arm engage the keeper with optimum tension. If the tension is too great, the latch either will not close or when closed will create excessive compression forces on the aircraft components and consequently damage them or the latch itself. If the tension is too loose, i.e. the latch arm not fully engaged with the keeper, suitable tension will not be provided to maintain the panel tightly affixed to the aircraft. Consequently, it has been known to provide some type of adjusting means either on the latch itself or on the keeper to accurately adjust the latch arm relative to the keeper during initial installation of the latch and subsequently when stresses in the aircraft may misalign the aircraft components.

A major disadvantage of some prior adjusting means is that the latch must be open to make the adjustment. Since the proper distance of the latch arm and resulting tension on the latch cannot be ascertained until the latch is closed, it is often necessary to make several adjustments through trial and error, with attendant opening and closing of the latch, before final adjustment is obtained. This is compounded and becomes more difficult when there are a plurality of latches aligned in a row on a large aircraft panel. Here, it has been found that after adjusting one latch, adjustment of the next latch may adversely affect the adjustment of the prior latch such that the whole process has to be continually repeated. Opening and closing of latches to effect this type of adjustment is both time consuming and cumbersome.

Although it is known to provide an adjusting means for a latch that will enable the latch to be adjusted when installed and closed, as shown in U.S. Pat. No. 4,053,177, such an adjusting means cannot be effectively used with a multipivot latch, the type of latch which this invention relates to.

SUMMARY OF THE INVENTION

Therefore, it is a broad object of this invention to provide a flush-mounted, multipivot hook latch, particularly suitable for latching an aircraft panel, and which can be easily adjusted after latching the panel to the aircraft structure without opening the latch.

Another object is to provide a multipivot, adjustable hook latch which is economical and feasible to manufacture.

Further objects of the invention will in part be obvious and will in part appear hereinafter.

In a brief summary, the multipivot hook latch constituting this invention comprises a plurality of interconnecting, latching components housed within a rigid housing which is in turn adapted to being supported on support brackets carried on the interior of an aircraft panel.

A latch handle, which operates the latch, is releasably locked to the housing at one end of the handle and is pivoted about a free-standing pivot pin at its other end. A connecting linkage connects this pivot pin to a fulcrum pin carried on a closing member which is in turn pivoted to the latch housing. The closing member is spring biased downwardly and is in operative engagement with the handle by a catch on the handle engaging the fulcrum pin.

The handle is also pivotally connected to a yoke which is in turn operatively connected to a latch arm having a hook for engagement with a keeper on the aircraft structure. The yoke carries a latch adjustment screw which bears against the latch arm in a direction to pivot the latch arm relative to the keeper.

Pivoting the latch handle upwardly to its unlatched position against the spring tension on the closing member causes the handle pivot axis to move downwardly, the closing member to pivot upwardly, and the latch arm to pivot away from the keeper on the aircraft structure. Conversely, closing the handle member causes these components to move in an opposite direction, thereby moving the latch arm into engagement with the keeper.

The latch components are specifically arranged such that the latch arm may be moved relative to the keeper after the latch is fully latched to the keeper by rotating th adjustment screw with a conventional drive tool such as an Allen wrench or the like inserted through a small opening in the top of the housing. Rotation of the screw clockwise pivots the latch arm toward the keeper and rotation of the screw counterclockwise allows the latch arm to pivot away from the keeper. Tension on the latch may be accurately measured by measuring the torque on the adjustment screw by a torque wrench or the like.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAIL DESCRIPTION OF THE PREFERRED EMBODIMENT

Figure 1:
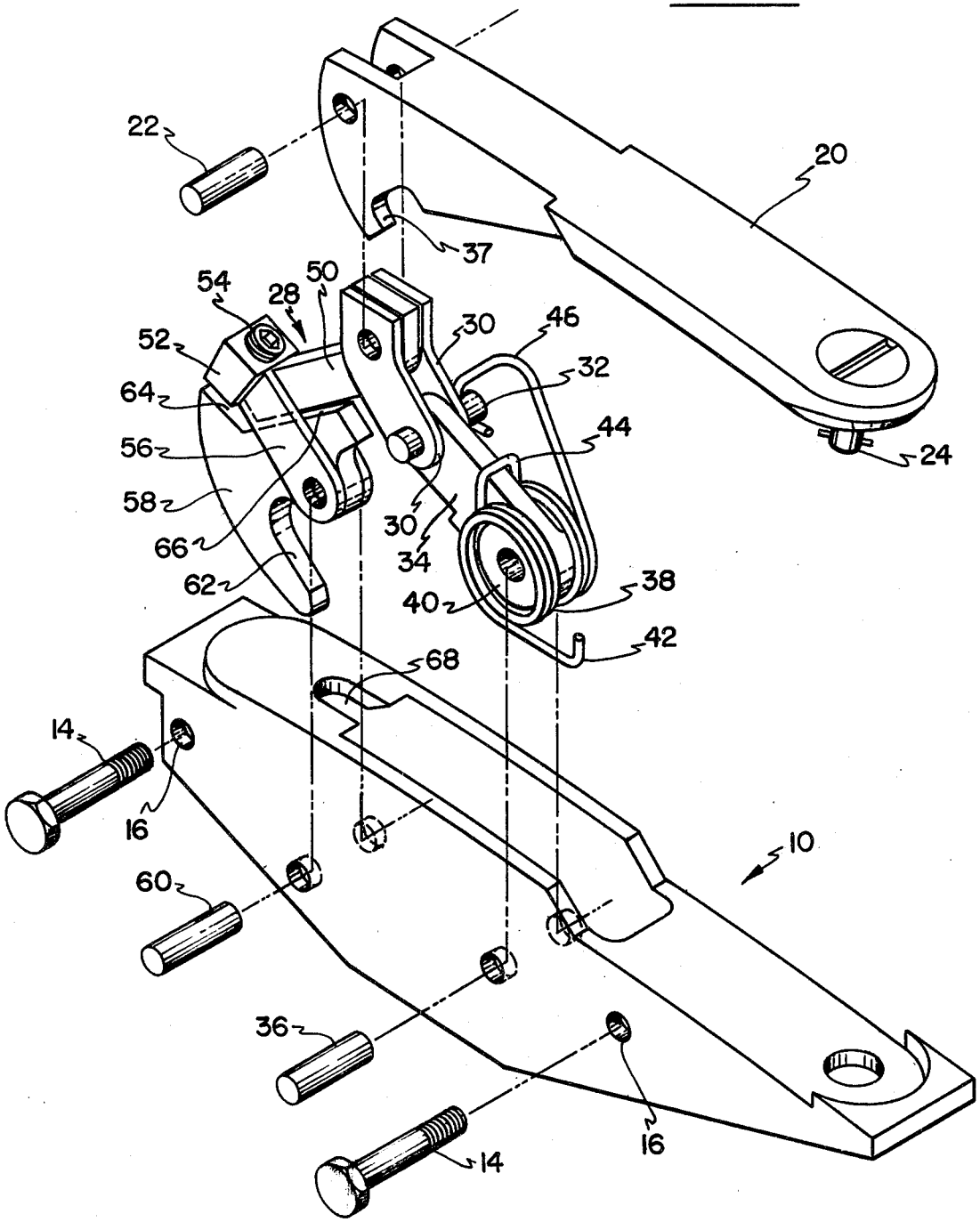
FIG. 1 is an exploded isometric view of the components of the adjustable, multipivot latch consituting this invention.

Referring now to the drawings in detail, the latching components of the latch constituting this invention are housed within a rigid housing 10, preferably cast of a lightweight material such as aluminum or the like. The housing protects the latch components as well as providing structural rigidity for the latch.

Figure 3:
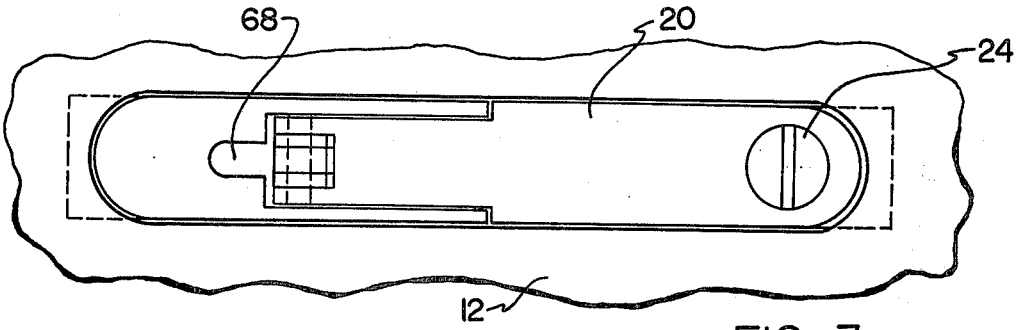
FIG. 3 is a view of the top of the latch taken along the line 3—3 of FIG. 2, particularly showing the access opening for the adjustment screw.
Figure 2:
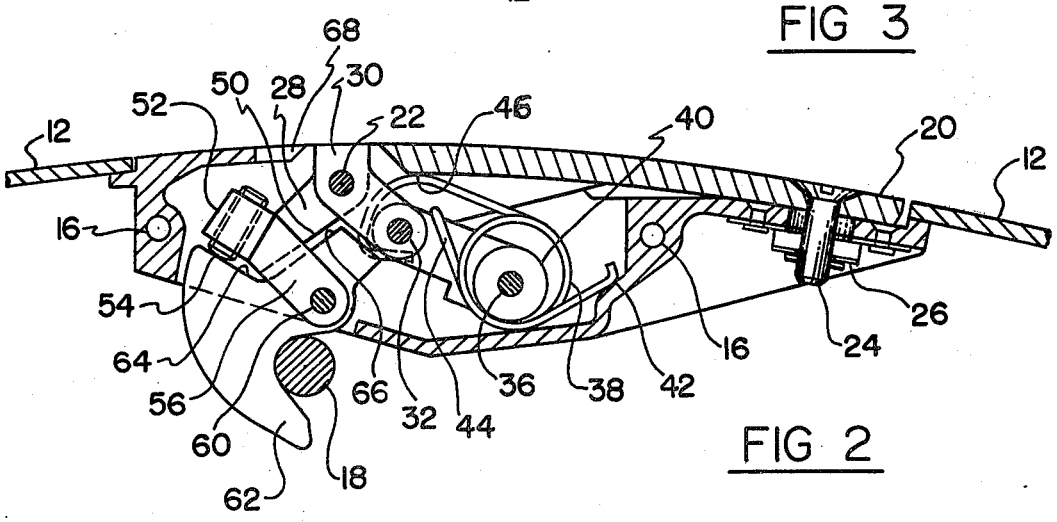
FIG. 2 is an elevational view, partially in cross-section, showing the latch in its fully latched position in combination with an aircraft panel, only a portion of which is shown.
Figure 4:
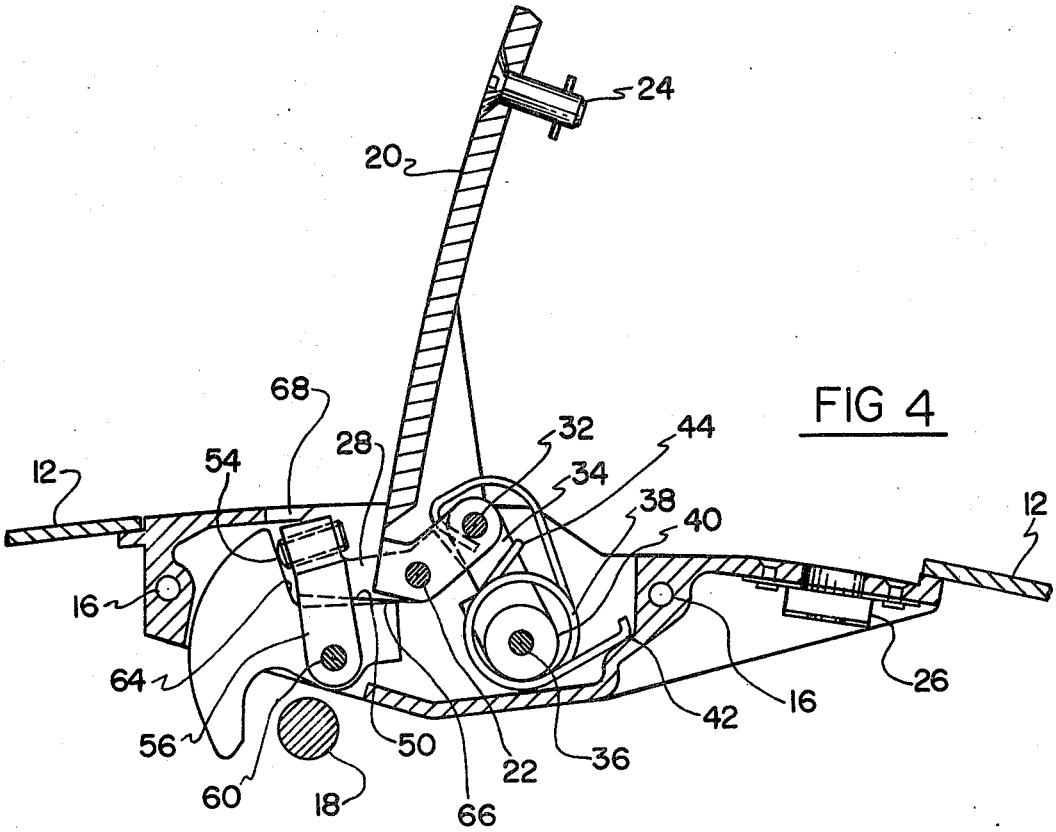
FIG. 4 is the same view of the latch shown in FIG. 2 but with the latch in its unlatched position.

In FIGS. 2, 3, and 4, the latch is shown in combination with an aircraft panel 12 with which it is preferably used. The latch is flush-mounted to the top of panel 12 with housing 10 being secured to latch support brackets, not shown, attached to the bottom of the panel, by mounting bolts 14 extending through mounting bolt opening 16 in the housing. A keeper or pin 18 is attached to the aircraft structure for engagement by the latch.

The latching components comprise a rigid latch handle or latch operator 20 pivotally mounted at one end about a freestanding handle pivot pin or axis 22. At its other end, latch handle 20 carries a rotatable locking pin 24 which locks the handle to the top of the housing when the locking pin is rotatably engaged with a conventional, slotted locking plate 26 attached to the bottom surface at the end of the housing 10 where shown.

Also pivotally mounted about the handle pivot axis 22 is a pair of connecting links or linkage 30. The connecting linkage 30 connects the handle pivot axis with, and is pivoted to, a fulcrum pin 32 carried at one end of a rigid closing member 34. The other end of closing member 34 is pivotally mounted about a fixed pin or axis 36 secured at each end to latch housing 10.

The body of handle 20 is slotted at its pivot end and the slotted portion extends over the connecting linkage 30 with the handle mounted about pivot pin 22, as shown. At this end, the handle continues downwardly and to the right as viewed, terminating with a recessed wall or catch 37 for operative engagement with fulcrum pin 32.

A continuous, double-coil coilspring is coiled around the lower end 40 of the closing member with one leg 42 of the spring bearing against an inner wall of the housing, a center portion 44 of the spring folded over the upper wall of the closing member, and the other leg 46 of the spring extending above and in contact with the underside of the latch handle.

Spring 38 has a dual function. First, it biases the closing member downwardly, or counterclockwise, as viewed. Thus, when the latch is latched, the spring tension assists in maintaining the latch in a closed or latched condition. Conversely, when the latch is unlatched, the spring tension on the closing member keeps the latch arm substantially within the housing, and away from the keeper.

The second function of spring 38 is to push the handle when unlocked above the housing to a degree which will facilitate gripping the handle by hand when it is desired to unlatch the latch. This is provided by the contact of leg 46 of the spring with the latch handle.

Turning to the other side of the generally V-shaped pivot assembly, yoke 28 has a central body 50 pivoted at one end to the free-standing pivot pin 22. Integral with the body are first a threaded screw housing 52 at its forward end through which is threadably engaged an adjustment screw 54 and second, a depending pair of yoke arms 56 extending in a direction generally opposite to that of the screw housing. The yoke arms 56 extend over a latch arm 58 and both the yoke arms and latch arm are pivoted to a pivot pin 60 secured at each end to latch housing 10. The adjustment screw has a conventional drive opening at its upper end for engagement with a drive tool, such as an Allen wrench.

Latch arm 58 is formed with a latch hook 62 at the lower end protruding through a slot in the bottom of the housing, a bearing surface 64 generally radially aligned with a pivot pin 60 and located near the outer perimeter of the latch arm, and a cam surface 66 on a counter arm extending from the bearing surface adjacent to the underside of body 50 of yoke member 28. Cam surface 66 extends beyond the pivot pin 60 opposite the hook and is suitably positioned for operative engagement with the body of yoke 28 when the latch is unlatched as will hereafter be described. Hook 62 faces generally the clamped end of the latch handle and is positioned to be engaged with the keeper 18 on the aircraft structure.

By the particular arrangement of the components, adjustment screw 54 is positioned to bear against the bearing surface 64 of the latch arm with the driven end of the screw facing and aligned with a small access opening 68 in the top of the housing. The adjustment screw may be rotated by a drive tool, such as an Allen wrench or the like, by inserting the drive tool through opening 68 and into engagement with the screw. It is important aerodynamically that this access opening be kept as small as possible to maintain the drag on the aircraft on which the panel is installed to a minimum.

All the above described latch components, with the exception of a part of the latch arm and latch handle, are contained within the housing. All the components are known except the latch adjustment means generally comprising the yoke 28, latch arm 58, and adjustment screw 54.

In operation, when it is desired to remove the panel, the latch is unlatched, as seen in FIG. 4. This is accomplished by first rotating pin 24 until the pin is free from the locking plate 26. Spring 46 then moves the clamped end of the latch handle 20 upwardly away from the housing whereupon it may be easily gripped by the hand. The handle is then pulled upwardly, and pivoted about the pivot pin 22. This causes catch 37 to engage fulcrum pin 32 of the closing member and pivot the closing member upwardly against the spring tension of spring 44.

Concurrently, as the handle is pivoted upwardly, pivot pin 22 moves downwardly causing the bottom surface of the body 50 of yoke 28 to contact the camming surface 66 of the latch arm. This cams or pivots the latch arm about its pivot pin 60 away from the keeper 18. The panel may then be removed from the aircraft.

Conversely, when it is desired to latch the panel, the handle is closed which reverses the above described movement of the latching components, the latch arm being pivoted by the adjustment screw bearing on the bearing surface. The hook is thereby once again engaged with the keeper, as shown in FIG. 2. The spring tension bearing on the closing member assists in latching the latch.

When the latch is in its latched position, hook 62 should engage keeper 18 with optimum tension. If the hook is too close to keeper 18, large stresses will be produced by the latch which may damage either the latch itself, the panel, or the aircraft structure. Conversely, if the hook is too far from the keeper, sloppiness may occur and the panel will not be adequately secured.

To adjust the distance between the hook and the keeper, and thereby the tension in the latch, a drive tool, such as an Allen wrench, may be inserted through the access opening 68 in the top of the housing and into engagement with the adjustment screw 54. Rotation of the adjustment screw in a clock-wise direction moves the screw forwardly and pivots the latch arm toward the keeper 18 thereby increasing the tension in the latch.

Conversely, rotation of the adjustment screw counterclockwise moves the screw outwardly thereby allowing the hook to move away from the keeper and thereby reduce the tension in the latch. Since the tension on the hook, and thereby the tension in the latch, is a direct function of the torque on the adjustment screw, the tension can be accurately adjusted and determined by measuring the torque on the adjustment screw with a torque wrench.

Now that the invention has been described, it should be obvious that an adjustable, flush-mounted, multipivot hook latch has been provided with important advantages. By the particular arrangement of parts, the latch arm may easily and quickly be adjusted relative to the keeper without the necessity of opening the latch. Conveniently, the tension on the latch may be determined for optimum latch tension by measuring the torque on the adjustment screw by a torque wrench or the like. Moreover, since the latch components are simple and easy to assemble, the latch may be made economically and feasibly.

It will thus be seen that the objects set forth above, among those made apparent from the preceeding description, are efficiently obtained and since certain changes may be made in the above construction without departing from the scope of the invention, it is intended that all matter contained in the above description or shown in the accompanying drawings shall be interpreted as illustrative and not in a limited sense.

It is also to be understood that the following claims are intended to cover all of the generic and specific features of the invention herein described, and all statements of the scope of the invention, which as a matter of language, might be said to fall therebetween.

Now that the invention has been described I claim:

1. An adjustable aircraft panel latch comprising:

(a) a latch housing with mounting means thereon for attachment to a panel and with a small access opening in the top;

(b) a latch handle pivotably mounted about a free-standing pivot axis at a first end thereof, said handle having a latched and unlatched position, and said pivot axis movable within said housing;

(c) a closing member pivotally mounted to said housing at one end thereof and having a fulcrum pin at the other end thereof, said closing member spring-biased downwardly;

(d) a connecting linkage connecting the free-standing pivot axis of the handle to a fulcrum pin on the closing member, said linkage pivotally mounted to the pivot axis at one end and pivotally mounted to the fulcrum pin at the other end thereof;

(e) the pivotally mounted end of the handle having a catch thereon for operative engagement with the fulcrum pin;

(f) a latch arm pivotally mounted to said housing about a latch arm pivot axis, said latch arm having a latch hook extending on one side of the latch arm pivot axis and a cam surface on the opposite side thereof, and said latch arm having a bearing surface thereon for pivoting said latch arm about said pivot axis;

(g) a yoke member having a central body pivotally connected at one end to the free standing pivot axis, a threaded housing carrying an adjustment screw extending from the other end of the body, a pair of yoke arms depending from said yoke body and pivotally mounted about said latch arm pivot axis, and the yoke body lying adjacent the cam surface of the latch arm for operative engagement therewith;

(h) the driven end of the adjustment screw being aligned with access opening in the housing and the opposite end of the screw being positioned to bear against said bearing surface of said latch arm in a direction to pivot said latch arm about its pivot axis; and (i) the free-standing pivot axis of the handle moving downwardly and in turn causing the yoke body to contact the cam surface of the latch arm and thereby pivot the hook of the latch arm upwardly when said handle is pivoted from its latched to its unlatched position.

2. The panel latch of claim 1 in combination with an aircraft panel.

* * * * *